United States Patent [19]

Dickstein

[11] Patent Number: 4,834,163

[45] Date of Patent: May 30, 1989

[54] VERTICAL LOUVER ASSEMBLY

[75] Inventor: Victor Dickstein, Miami Beach, Fla.

[73] Assignee: Scientific Plastics, Inc., Miami, Fla.

[21] Appl. No.: 182,838

[22] Filed: Apr. 18, 1988

[51] Int. Cl.[4] ..... E06B 9/26

[52] U.S. Cl. ..... 160/176.1; 160/177; 160/900

[58] Field of Search ..... 160/176.1, 177, 900

[56] References Cited

U.S. PATENT DOCUMENTS

| | | | |
|---|---|---|---|
| 3,996,988 | 12/1976 | de Wit | 160/176.1 X |
| 4,306,608 | 12/1981 | Frentzel et al. | 160/176.1 |
| 4,386,644 | 6/1983 | Debs | 160/900 X |
| 4,552,195 | 11/1985 | Dürig et al. | 160/900 X |
| 4,628,981 | 12/1986 | Ciriaci et al. | 160/176.1 |
| 4,648,436 | 3/1987 | Oskam | 160/177 |
| 4,657,060 | 4/1987 | Kavcic | 160/176.1 X |
| 4,724,885 | 2/1988 | Chang | 160/176.1 X |
| 4,732,202 | 3/1988 | Anderson | 160/900 X |

*Primary Examiner*—Ramon S. Britts
*Assistant Examiner*—David G. Kolman
*Attorney, Agent, or Firm*—John Cyril Malloy

[57] ABSTRACT

A vertical louver assembly of the type designed to movably support a plurality of vertically oriented louvers from a horizontally oriented housing and accompanying track structure and a tilt rod extending along the length of the housing. Each louver is supported by a carrier assembly itself including a carrier frame structured to accomplish collective positioning of the louvers along the length of the housing and also in a rotatable orientation about their own longitudinal axis through operation of the tilt rod as well as other control facilities. Each carrier frame includes a biasing assembly disposed and structured to force gear elements into mating engagement with one another and a clutch assembly disposed and structured to allow for realignment of any louver which has become inadvertently disconnected without damage thereto.

14 Claims, 5 Drawing Sheets

VERTICAL LOUVER ASSEMBLY

BACKGROUND OF THE INVENTION

1. Field of the Invention

This invention relates to a vertical louver assembly of the type wherein a plurality of vertically oriented louvers are movably suspended so as to rotate along the length of a horizontally oriented track and also to be selectively rotated or tilted about their own longitudinal axis in synchronized positioning by the manipulation of a pull cord assembly.

2. Description of the Prior Art

Vertical blind assemblies or structures of the type incorporating a plurality of vertically oriented and depending louvers or blinds, capable of traversing the length of a track mounted on a suspended header or housing structure are well known in the prior art and commercially available to the public in various forms and designs. Typically, such assembly provides for the traversing movement of the plurality of depending blinds or louvers in the aforementioned fashion and also allows the angular rotation or tilting of the blinds collectively into a common, synchronized angular orientation about the respective longitudinal axes of the blinds. This angular orientation controls or regulates the amount of light or viewing through the individual blinds. Vertical blind assemblies of the type set forth above generally include a carrier element removably secured to an upper end thereof. Each carrier element is pivotally or rotatably mounted on a carrier assembly. Individual carrier assemblies are extendable collectively along the length of the header casing or alternately retracted into a closely adjacent position. Such positioning depends on whether it is preferred to extend the vertical blinds or louvers along the entire length of the housing or collect the blinds at one end thereof. The latter position allows complete passage or access through the opening which the vertical blind assembly is intended to overhang and possibly cover. The positioning structure or assembly is associated in driving interconnection with each of the carrier structures supporting the individual holders and attached blinds wherein each positioning means is structured to provide the aforementioned travel and/or angular pivotal movement of the blinds.

Numerous prior art structures are known which are specifically directed to the prior art of vertical blind assemblies. Structures of the type referred to are the subject of U.S. Pat. Nos. 4,262,728; 4,122,884; 4,616,688; 4,267,875; 4,239,021; and 2,754,902. While the structures disclosed in such patents are considered to be operable for their intended and designed purpose, frequently, numerous prior art structures are considered to be rather complex and therefore add to the initial expense of the vertical blind assembly or the cost of maintenance and/or repair of such structures.

While complexity is a factor in considering the structural components and operative features of blind assemblies of this type, it should also be kept in mind that various structural components utilized in the assemblies of the type set forth herein are frequently required to be replaced and/or repaired in order to keep the assembly in proper working order. Therefore, there is still a recognized need in the prior art relating to blind assemblies for the vertical blind structures specifically designed to be long lasting and durable and incorporate a design configuration which allows easy replacement and/or repair of the various components of such a structure without total disassembly.

SUMMARY OF THE INVENTION

This invention relates to a vertical louver assembly of the type comprising a plurality of vertically oriented louvers depending from a horizontally oriented housing and accompanying track structure. The housing and track structure are normally suspended above and substantially along the length of a window, passage, portal, sliding door, etc. such that the depending vertical louvers may selectively cover such passage, opening, etc. when in their fully extended position and selectively disposed along the length of the housing and track structure. Alternately, the louvers may be oriented in a certain parallel, tilted position relative to one another so as to allow selective amounts of light to pass therethrough. Positioning of the plurality of louvers either along the length of the housing and track structure or rotationally about their own longitudinal axis occurs by a substantially conventionally structured cord assembly including pull cord segments having an endless elongated loop configuration which may be positioned to be manipulated by the user thereof. A beaded or similarly structured pull chain may be used to operate a control assembly located at one end of an elongated tilt rod which also extends along the length of the housing and is supported at the opposite end thereof by securement means which along with the control means supportingly engaging opposite ends of the tilt rod.

An important part of the present invention is the provision of a plurality of carrier assemblies. Each carrier assembly includes a carrier frame generally formed into an integral one piece construction. Each of the carrier frames are disposed in surrounding concentric relation about the elongated tilt rod which is structured in the form of an elongated pinion gear. Further, common connecting means serve to interconnect the plurality of support frames such that they may move relative to one another upon operation and manipulation of the aforementioned cord assembly as they extend outwardly along the length of the housing and track assembly. Alternately, the louvers are collectively positioned into a "bunched" array or disposition thereby providing free passage to the opening, window, etc. Provision is made on each of the support frames for the inclusion of spaced apart apertures. Each aperture is designed to allow movable passage therethrough of a cord segment of the cord assembly without such cord assembly interfering with or fouling movement of the carrier frames along the length of the aforementioned track structure.

A support or tilt stem is removably mounted on each of the support frames and transversely oriented to the length of the tilt rod. Further, each of the tilt stems are rotatable about their own longitudinal axis and removably securable in supporting relation to an upper end of a vertical louver.

An important part of the present invention is the provision of a gear assembly comprising a first gear element movably mounted on the carrier frame and preferably having a linear configuration. This first gear element is externally configured to matingly engage the outer surface of the tilt rod such that rotation of the tilt rod along its own longitudinal axis is translated into linear movement of the first gear element due to mating engagement therebetween.

The gear assembly further includes a second gear element preferably in the form of a circular gear secured to a head portion or proximal end of the tilt stem substantially by a clutch assembly, to be described in greater detail hereinafter. The second gear element is specifically disposed to mate with what may be considered internal pockets of the first gear element such that linear movement of the first gear element caused by rotation of the lilt rod is translated into rotational movement of the second gear element and accordingly rotation of the tilt stem about its own longitudinal axis. Due to the fact that each of the tilt stems is secured to one end of a vertical louver, rotation of the tilt stem accordingly caused syncrhronized angular orientation or "tilting" of the louvers relative to one another about their own longitudinal axis.

An important feature of the present invention is the provision of biasing means associated directly with and formed on each support frame. The biasing means is brought into engagable relation with either end of the first gear elemet when such gear element is extended to its maximum length of travel in a single direction. The biasing means includes oppositely disposed spaced apart biasing fingers or spring elements disposed to biasingly engage correspondingly positioned ends of the first gear element thereby biasing or normally forcing it back into engagement with the second gear element. This biasing engagement insures that at all times the first and second gear elements will be effectively forced into mating engagement with one another thereby reducing the possiblity that one of the tilt stems and the vertical louver attached thereto will be forced out of synchronized positioning relative to the other louvers.

Other important features of the present invention relate to a clutch assembly used to interconnect the circular gear of the tilt stem to the remaining portions of the stem and allowing relative movement therebetween under forced conditions. This will allow realignment of any inadvertently misaligned tilt stems and/or vertical louvers relative to the others without disassembly of the entire carrier frame and its components or damage to the stem or louver itself.

The control means includes a drive gear arrangement for the tilt rod and being interconnected to one end thereof such that pulling motion of the beaded pull chain which engages a portion of the control assembly through the various gear ratios associated with the drive gears of the control means serves to rotate the tilt rod relative to its own longitudinal axis at a desired rate of rotation which in turn causes synchronized angular orientation of all of the tilt stems and their supported louvers relative to one another.

BRIEF DESCRIPTION OF THE DRAWINGS

For a fuller understanding of the nature of the present invention, references is made herein to the following drawings in which.

Like reference numerals refer to like parts throughout the several view of the drawings.

DETAILED DESCRIPTION OF THE PREFERRED EMBODIMENT

As shown in FIGS. 1 through 5, the present invention is directed towards a vertical blind assembly generally indicated as 10 and including a housing 12 having a somewhat elongated configuration of sufficient length to extend in overlying relation to a portal, passage, doorway, etc. not specifically shown in the figures herein.

The housing 12 has formed therein an elongated track assembly 14 designed specifically to support and allow travel along the length thereof of a plurality of carrier assemblies generally indicated as 16.

Figure 1:
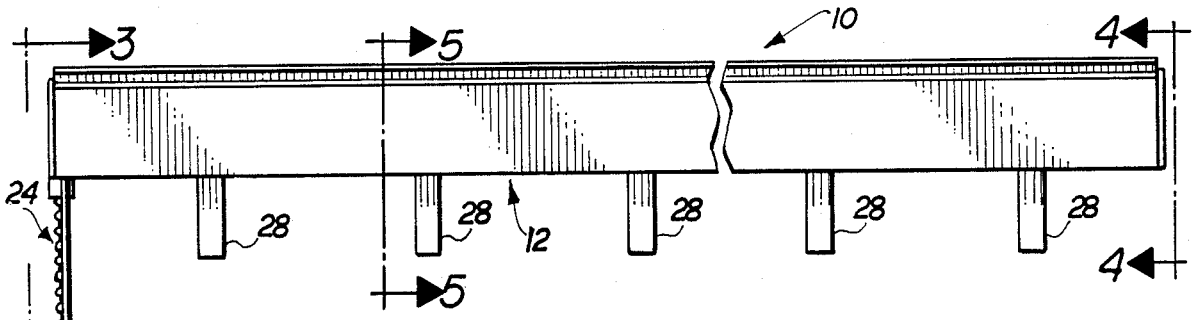
FIG. 1 is a front view of a housing of a vertical blind assembly in partial cutaway.
Figure 2:
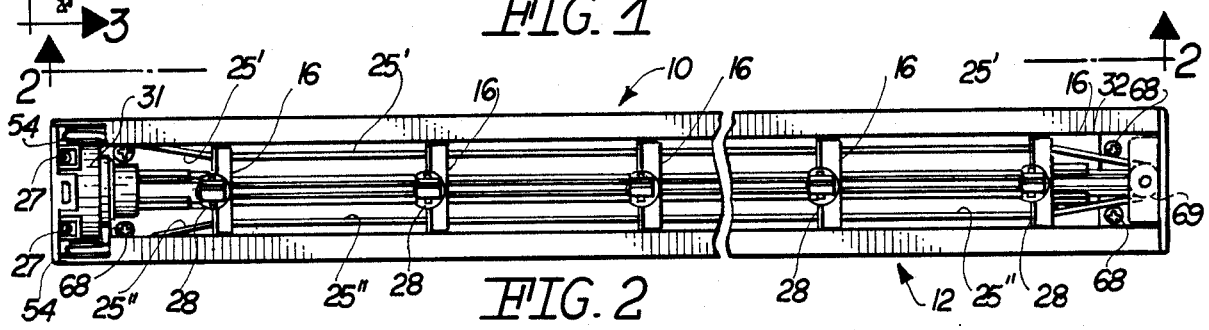
FIG. 2 is a bottom view along line 2—2 of FIG. 1.
Figure 3:
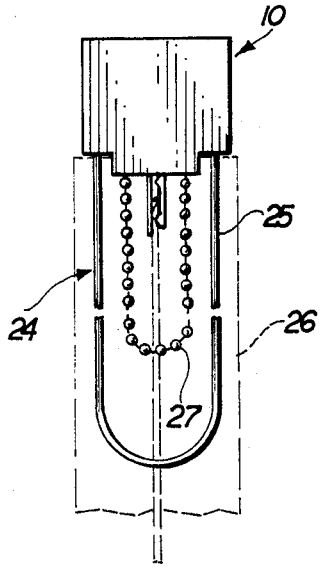
FIG. 3 is an end view along long 3—3 of FIG. 1.
Figure 5:
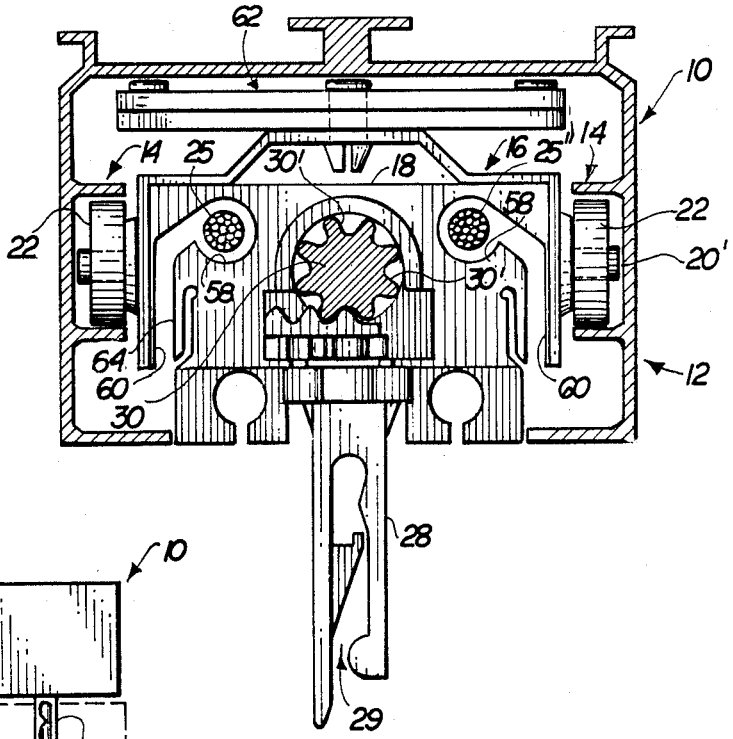
FIG. 5 is a sectional view along line 5—5 of FIG. 1 showing interior details of the housing and specific structural details of a carrier assembly of the subject invention.
Figure 5B:
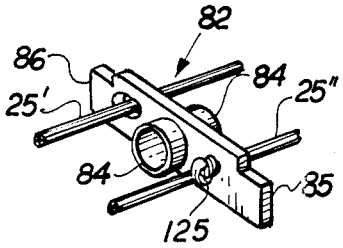
FIG. 5B is a perspective view in detail of a supplementary support for a tilt rod associated with the vertical assembly of the present invention.
Figure 4:
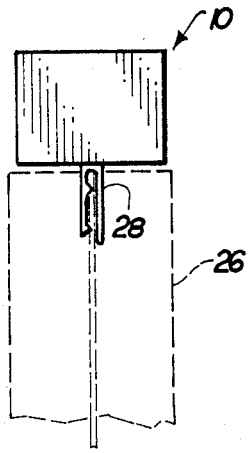
FIG. 4 is an opposite end view along line 4—4 of FIG. 1.
Figure 5A:
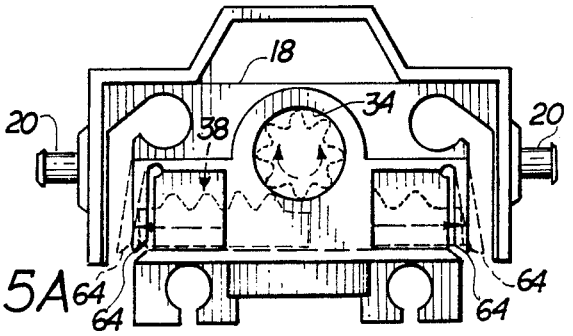
FIG. 5A is a front view in detail of a support frame as part of the carrier assembly of the present invention.
Figure 9:
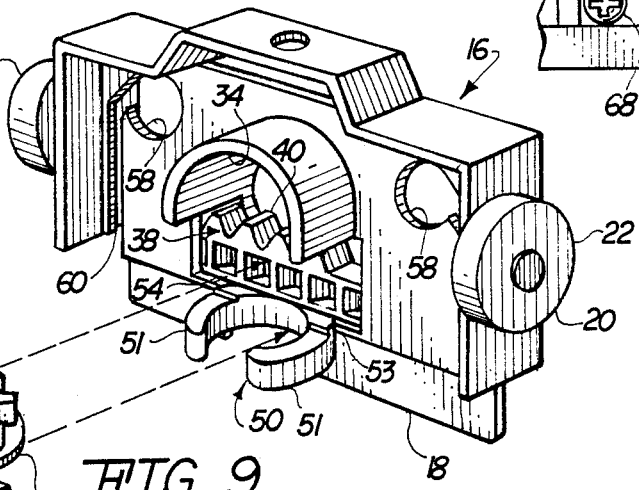
FIG. 9 is a perspective view in exploded form of the carrier assembly of the present invention with a tilt stem secured thereto.

More specifically, each carrier assembly 16 comprises a support frame 18 (see FIGS. 5, 5A and 9). The support frames 18 are each preferably formed of a substantially one piece construction. For purposes of moving along the length of the housing and specifically engaging the track structures 14, outwardly extending stub fingers or axles 20 are provided. Rollers 22 are rotatably mounted on the axles 20 and are dimensioned and configured to fit within the track assembly 14 as best shown in FIG. 5. As will be explained in greater detail hereinafter, a control assembly including a control cord assembly generally indicated as 24 and a beaded pull chain 27 are manually operable so as to accomplish both travel of each of the plurality of carrier assemblies 16 along the length of the track structure and housing and also to accomplish rotational or tilting movement of the tilt stems 28 and the individual supported vertical louvers represented in phantom lines as at 26. Each of the louvers are secured in vertically depending relation to the housing 12 by means of the plurality of tilt stems 28 attached in a removable fashion to the upper end of the various vertical louvers 26 as shown in FIG. 4.

As shown both in FIGS. 5 and 9, each of the tilt stems includes a main body portion having a substantially bifurcated configuration defined by a gripping portion generally indicated as 29. The gripping portion is separated so as to allow the upper end of the individual louvers 26 to fit therein and yet be removable therefore for replacement or repair.

Another important feature of the present invention is the provision of a tilt rod generally indicated as 30 and comprising an elongated configuration having opposite ends affixed to and supported by a control means 31 activated by pull chain 27 and by a securement means in the form of an oppositely disposed securement assembly 32. As is convention in the prior art, the tilt rod 30 is connected at its opposite ends to control means 31 and the securement assembly 32 and is rotatable about is own longitudinal axis upon the pulling of the elongated beaded pull chain 27.

Figure 14:
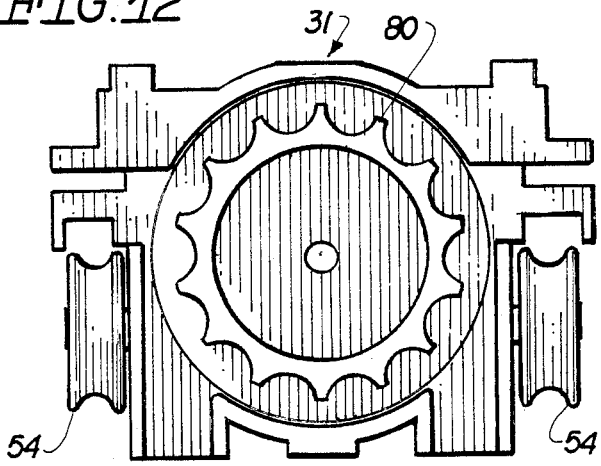
FIG. 14 is an outside end view along line 14—14 of FIG. 17 of the embodiment of FIG. 12.
Figure 15:
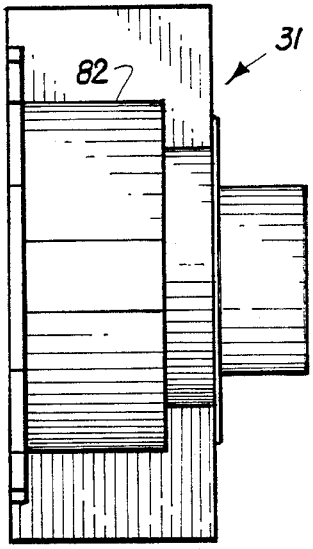
FIG. 15 is a top view of the embodiment of FIG. 12.
Figure 16:
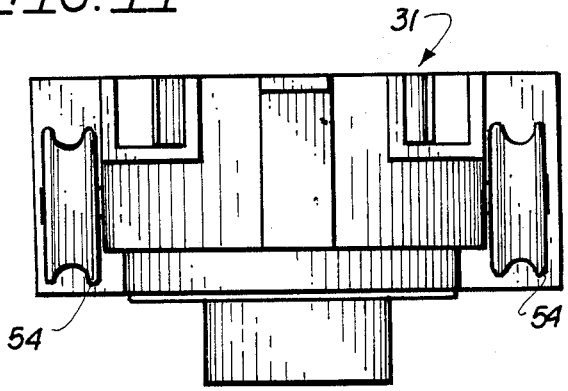
FIG. 16 is a bottom view of the embodiment of FIG. 12.
Figure 17:
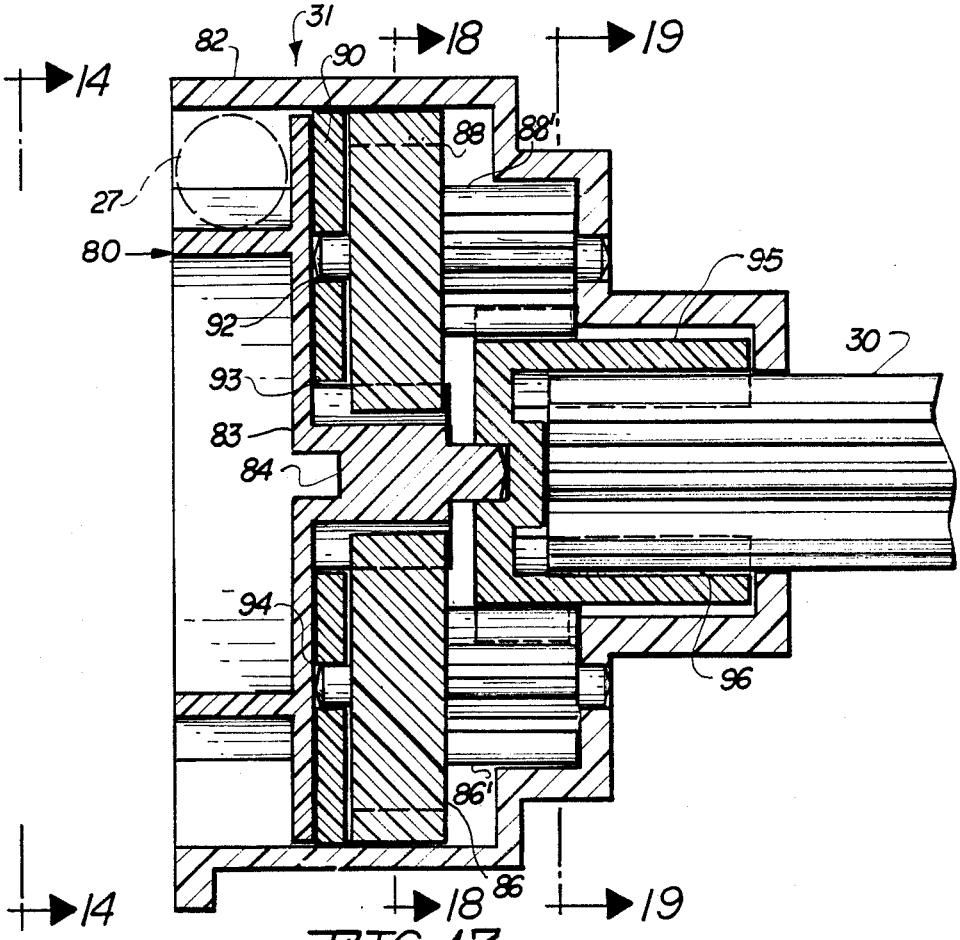
FIG. 17 is a longitudinal sectional view showing interior structural details of the drive gear assembly associated with the driving of the tilt rod of the present invention.

As shown in the various figures and particularly with reference to FIGS. 14 and 17, the beaded pull chain 27 is cooperatively engaging and serves to rorate an external sprocket type gear 80 of the control means generally indicated as 31. Specific structural features of the control means 31 and the drive gear assembly used to rotate the tilt rod 30, of which sprocket gear 80 is a part, will be discussed in greater detail hereinafter with specific reference to FIGS. 12 through 19. However, as is well known, pulling vertically in opposite directions of the pull chain 27 causes a rotation of the sprocket gear 80, in a corresponding direction, with the attendant rotation of the tilt rod 30 about its own longitudinal axis.

Figure 6:
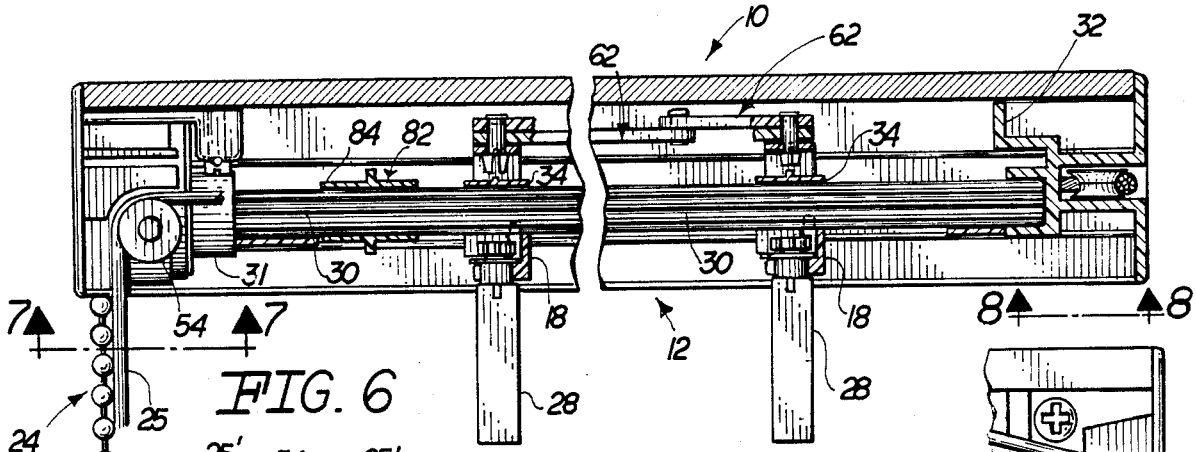
FIG. 6 is a longitudinal sectional view in partial cutaway showing interior features of the vertical blind assembly of the present invention.
Figure 8:
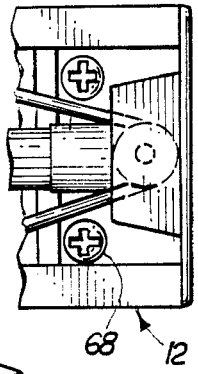
FIG. 8 is a bottom view in partial cutaway along line 8—8 of FIG. 6.
Figure 7:
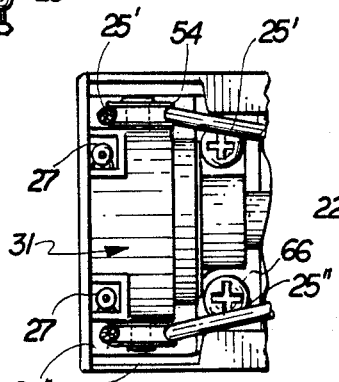
FIG. 7 is a bottom view in partial cutaway and section along lines 7—7 of FIG. 6.

With reference to FIGS. 5, 5A and 9, each of the plurality of carrier assemblies 16 and more specifically the support frame 18 includes a substantially centralized aperture and/or partial sleeve as at 34. The sleeve is disposed in at least partially surrounding and somewhat concentric relation to the placement of the tilt rod 30 as the tilt rod passes through each of the carrier assemblies as clearly shown in FIGS. 2 and 6. Rotation of the tilt rod about is own longitudinal axis in either direction in turn causes rotation of the individual tilt stems 28 and the attached vertically oriented louvers 26 about their own longitudinal axis in a manner that causes a synchronized and parallel orientation and positioning of each of the louvers 26 relative to one another. In this manner, light passing through the louvers or viewing therethrough can in fact be regulated, as also well known in the prior art.

Figure 10:
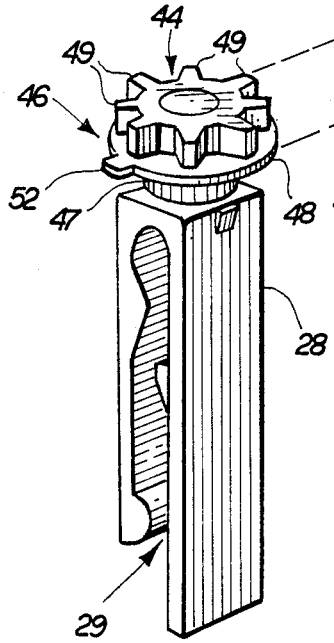
FIG. 10 is a front detail view of a first gear element associated with the present invention.
Figure 10:
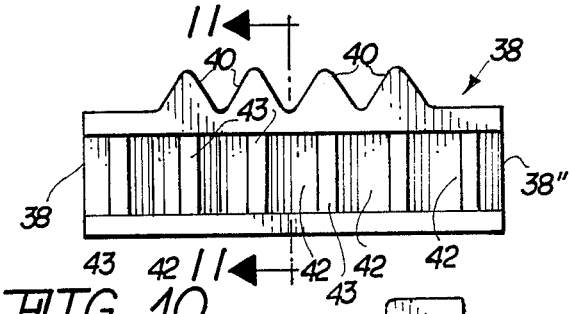
Figure 11:
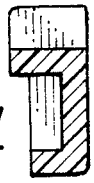
FIG. 11 is a sectional view along line 11—11 of FIG. 10.
Figure 12:
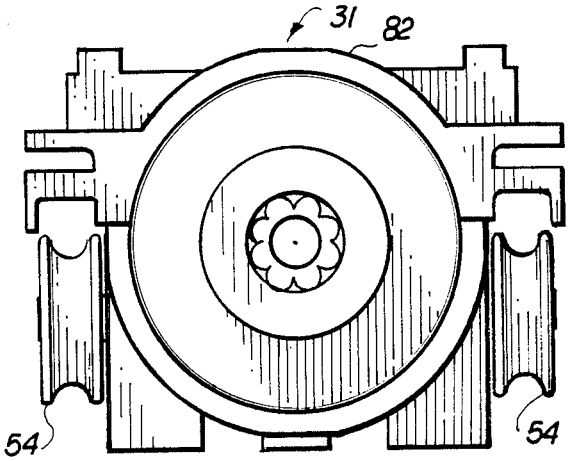
FIG. 12 is an inside end view of the control assembly of the present invention and the exterior casing therefor.
Figure 13:
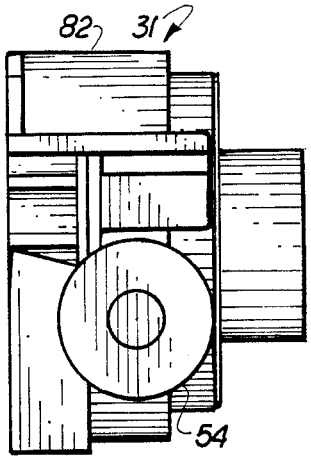
FIG. 13 is a side view of the embodiment of FIG. 12.

The present invention further includes a gear assembly including a first gear element (see FIGS. 9, 10 and 11) generally indicated as 38 and having a somewhat elongated configuration. The first gear element 38 includes an outer surface configuration including a plurality of teeth 40 also linearly configured and specifically disposed to engage and mate with a plurality of tines 30' formed on the outer surface of the tilt rod and extending also along its length. It should be readily apparent therefor that rotation of the tilt rod 30 about its own longitudinal axis in turn causes or is translated into linear motion of the first gear element 38. The direction of rotation of the tilt rod 30 of course is determinative of the direction of lienar travel of the first gear element 38.

Figure 21:
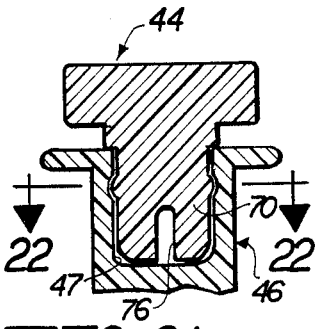
FIG. 21 is a sectional view in partial cutaway along line 21—21 showing structural details of a head portion of the stem and its associated gear serving to define a clutch assembly with the remainder of the tilt stem.
Figure 22:
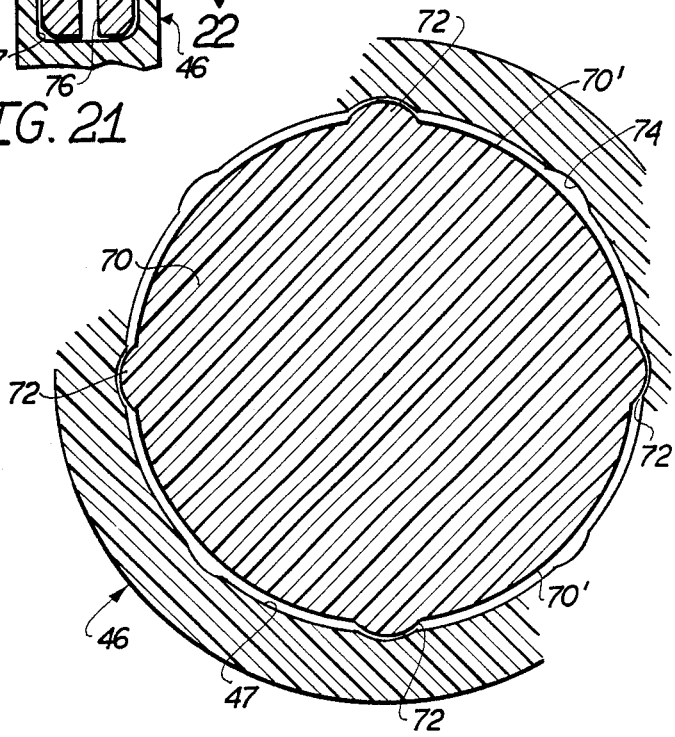
FIG. 22 is a sectional view in partial cutaway along line 22—22 of FIG. 21.

Also as best shown in FIG. 9, the gear assembly of the present invention comprises a second gear element 44 movably mounted to a receiving head portion generally indicated as 46 of the tilt stem 48 and more specifically within a socket 47. The socket 47 and the receiving end 70 of the gear 44 are cooperatively dimensioned such that a frictional engagement exists therebetween. Accodingly, the gear 44 is firmly mounted to extend outwardly from the head portion 46 of the tilt stem 28 and under most conditions rotate therewith. However, under extreme force conditions the end 70 of the gear 44 may in fact rotate relative to the inner surface of the socket 47. However, a certain clutching action occurs by virtue of the existence of a plurality of outwardly extending nipples 72 integrally formed on the outer surface 70' on the end 70 of the gear 44. These spaced apart nipples 72 are dimensioned and configured to be received within congruently shaped recesses 74 formed on the inner surface of the socket 47 as shown in detail in FIG. 22. When sufficient force is exerted on the tilt stem 28, relative rotation of the stem 28 and the head portion 46 thereof will occur relative to the gear 44. This will allow physical or manual repositioning or realignment of any of the louvers as well as the tilt stem 28 to which they are attached, relative to the other plurality of louvers when any one louver becomes inadvertently misaligned. Such realignment can occur due to the clutch assembly as shown in FIGS. 21 and 22 without disassembly of or damage to the various components of the tilt stem 28, gear 44 or carrier frame in general. However, when normal rotational forces are applied to the gear 44 as by the elongated first gear element 38, the gear 44 will of course rotate with the gear stem 28 about the longitudinal axis thereof causing the angular orientation of the various vertical louvers 26. Further structural features of the receiving end 70 of the first gear element 44 is a split construction as at 76 which enables a somewhat compressed configuration of the end 70 as it passes into the socket. Once placed in the position shown in FIG. 1, the end 70 is allowed effectively to expand into frictional engagement with the inner surface of the socket 47 for purposes of accomplishing sufficient frictional engagement between such surfaces and between the nipple 72 and the recesses 74 to allow concurrent rotation of the first gear 44 and the tilt stem 28 when normal rotational force is applied to either. It is obvious therefore that the rotation of the second gear element 44 causes axial rotation of the tilt stem 28. The second gear element 44 comprises a plurality of outwardly extending teeth 49 generally arranged, collectively, in a circular configuration so as to drive a pinion gear. Such plurality of teeth 49 are specifically dimensioned and disposed to cooperatively and matingly engage with a plurality of inwardly recessed pockets 42 separated by various petitions or teeth 43 and also collectively arranged in a linear array in integral formation on the first gear element 38.

Therefore, forced linear movement of the first gear element 38 due to rotation of the tilt stem 30 in turn translates to rotational movement of the tilt stem 28 about its own longitudinal axis due to the mating engagement of the first gear element 38 with the second gear element 44 and more specifically with the mating placement of teeth 49 within the plurality of pockets 42. It should be readily apparent therefore that manipulation of the pull chain 27 will in fact cause a simultaneously and synchronized rotation or "tilting" of each of the louvers 28 due to the rotation of the supporting tilt stems 28 as set forth above.

Also, from FIG. 9 it should be apparent that the head portion generally indicated as 46 includes a skirt and a depending member 47 designed to fit within the cradle generally indicated as 50 in a "snap fit" configuration due to the inherent flexibility of the arms 51 of the cradle and the open end which separates those arms.

A stop member or means is provided in the form of an outwardly projecting finger 52 secured to the skirt 48. The finger, upon rotation of the second gear element 44, abuts apainst stop members 53 or 54, dependent upon the direction of rotation thereby limiting the amount of rotating possible and reducing the possibility that the tilt stems 28 and the attached louvers 16 will be rotated beyond their intended distance.

As is also well known in the art, the plurality of carrier assemblies 16 are also capable fo being positioned selectively in spaced relation to one another along the length of the housing 12. This occurs by manipulation of the pull cord assembly 25 which is divided into pull cord segments 25' and 25" by means of guide rollers 54.

As also best shown in FIGS. 5 and 9, the cord segments 25' and 25" pass through each of the individual carrier assemblies 16 by means of the provision of spaced apart apertures 58 integrally formed in the support frame 18 on opposite sides of the tilt rod 30 as shown. Further, in order to properly place each of the cord segments 25' and 25" in an open ended channel means as at 16 is provided so as to communicate and allow passage and placement therethrough of the cord segments 25' and 25" into the apertures 58 as properly positioned in FIG. 5.

It should be readily apparent therefore that pulling or manipulation of the pull cord 25 will cause the positioning of the carrier assemblies 16 along the length of the housing 12 either into completely covering relation relative to the span of the tilt rod or in a "bunched" collected relation relative to one another such that the overhanging passage may be opened or closed as is well known. In order to facilitate movement of each of the carrier assemblies relative to one another and relative to the length of the tilt rod 30, an interconnecting facility such as a linkage assembly generally indicated as 62 is provided in interconnected relation to adjacent ones of the carrier assemblies 16.

Other features of the present invention are shown in FIGS. 5 and 5A and comprise a biasing means in the form of two spaced apart spring fingers or elements 64 disposed at opposite ends of the path of travel of the first gear element 38. In operation, when the first gear element 38 reaches its maximum distance of travel due to a forced linear movement by the tilt rod 30, it will come into biased engagement as at opposite ends 38' and 38" with one of the fingers 64. With specific reference to FIG. 5A, the position of the spring or biasing finger 64 in phantom lines represents an abutting positioning of the first gear element 38 as it is forced to its maximum distance of travel in that direction. Once so positioned, the force of the appropriately positioned biasing or spring fingers 64 will force the first gear element 38 back into mating engagement with the second gear element 44 rather than allow it to be maintained out of such mating engagement. By forced or biased engagement between the first and second gear elements 38 and 44, the tilting or rotation of each of the various vertical louvers 36 will be controlled.

Yet another feature of the present invention is the provision of the tilt rod support member 82 generally indicated as such in FIG. 5B. This supplementary support 82 includes an elongated hollow sleeve 84 disposed in surrounding concentric relation to the tilt rod 30 (see FIG. 6). The opposite ends of the tilt rod support, as at 85 and 86, are disposed, dimensioned and configured to fit within the track structure 14 (see FIG. 5) and in certain embodiments to move therealong. In the structural embodiment of the tilt rod support member 82 as pictured in FIG. 5B, such support member 82 is structured to engage the cord or at least a segment thereof paralleling the tilt rod as it extends along the length of the housing. Such cord is clearly indicated in FIG. 5B as 25' and 25". or metal head is formed in one portion of the cord segment 25' so as to effectively force travel of the tilt rod support 82 along the length of the tilt rod 30 and the housing 10 when the pull cord 25 is manipulated in either direction. Accordingly, in the embodiment shown in FIG. 5, the tilt rod support 82 effectively travels from one end of the housing 10 generally closest to or associated with the control means 31 towards the center of the housing 10 in constant surrounding and suppporting position relative to the tilt rod 30. Therefore, it should be apparent that when all of the carriers 18 and vertical louvers 26 are "bunched" towards one end of the housing 10 generally associated with the securement assembly 32, the tilt rod support 82 will be positioned substantially midway along the length of the tilt rod and support the tilt rod since the ends 85 and 86 still engage the track portions of the housing. This will prevent a bowing or bending of the tilt rod.

In certain other embodiments not shown herein, the louvers may be "bunched" at each opposite end of the housing simultaneously. In such an embodiment, the tilt rod support 82 does not effectively travel along the length of the tilt rod but maintains a substantially stationary position midway between the opposite ends. Therefore, even when the plurality of louvers 26 are in fact bunched at opposite ends, the tilt rod support 82 will still be maintained in a midway position along the length of the tilt rod and the same bowing or bending of the tilt rod will be prevented. In the latter embodiment, the knot 125 does not exist and the cord segments 25' and 25" are allowed to move freely relative to the tilt rod support 82.

It will also be noticed in FIG. 5B that the elongated hollow sleeve 84 protrudes from opposite surfaces or sides of the support 82. This generally provides stability to the support 82 as it travels along the length of the tilt rod and reduces the tendency for the support to skew into angular orientation and therefor jam along the length of the tilt rod. However, it should be noted that while the sleeve 84 is shown protruding from both sides or surfaces of the support 82, it may also protrude from only a single side and still be effective to prevent the undesirable skewing. Whether the sleeve protrudes from one or both sides of the support 82, it acts as a spacer between adjacent carrier frames as well as providing stability to the support 82 as it travels along the length of the tilt rod 30.

Another important feature of the present invention is the structural components and design of the control means 31 as pictured in detail in FIGS. 12 through 19. The control means 31 includes an exterior housing 82 encompassing the exterior sprocket type gear 80 rotatably driven by the beaded pull chain 27. The sprocket gear 80 includes a base portion 83 having a centrally disposed inwardly directed drive gear 84 secured thereto and rotatable therewith. Accordingly, the integrally formed sprocket gear rotates as a single unit within the housing 82 of the control means 31 and serves to drive two secondary drive gears 86 and 88 by virtue of mating engagement between primary portions of the secondary drive gears 86 and 88 with the central inwardly directed drive portion 84 of the sprocket gear 80. The two auxiliary gears 86 and 99 are maintained in place by a gear retaining member 90 being apertured as at 92 and 94 to rotatably receive and yet maintain in the position shown in FIG. 17 the primary portion of both secondary gears 86 and 88. The gear retainer 90 is maintained in a stationary position within the housing 82 and is formed from an integral one piece construction serving to surround but not engage the central portion 84 of the sprocket gear 80 by means of a centrally located aperture 93. To the contrary, the stubs 92 and 94 effectively rotate in appropriately positioned receiving apertures of the retainer 90 as clearly shown in FIG. 17.

Figure 18:
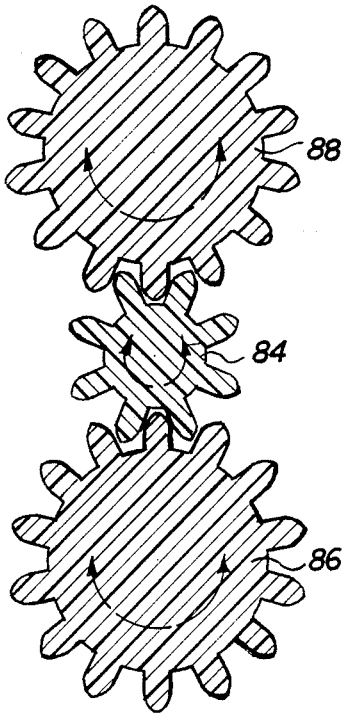
FIG. 18 is a sectional view along line 18—18 of FIG. 17 showing details and relative movement of the gear components of the drive gear assembly of the embodiment of FIG. 17.
Figure 19:
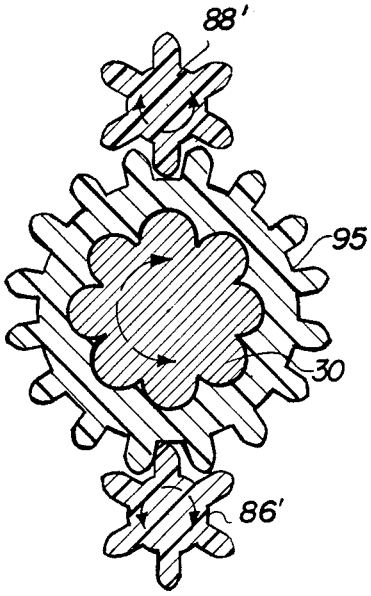
FIG. 19 is a sectional view along line 19—19 showing relative movements of the gear components of the drive gear assembly of FIG. 17 and their driving relation to one end of the tilt rod associated therewith.
Figure 20:
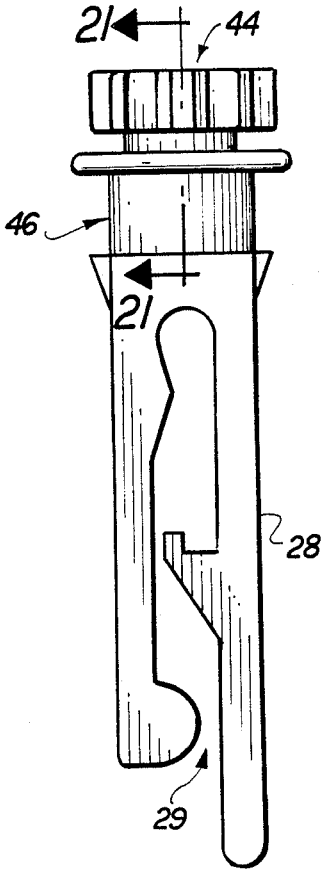
FIG. 20 is a detailed view of the tilt stem in detail.

With regard to FIG. 18, it is therefore seen that rotation of the central portion 84 of the sprocket gear 80 in either direction causes an attendant rotation of both of the primary portions 86 and 88 of the secondary gears. With reference to FIGS. 17 and 19, the secondary gears 86 and 88 also have secondary portions 86' and 88' integrally formed on the secondary portions 86 and 88 and rotatable therewith. The secondary portions 86' and 88' extend outwardly (FIG. 17) from their respective secondary portion into driving engagement with a primary drive gear 95 having its external surface matingly engaging with both of the secondary portions 86' and 88' of the secondary gears and driven thereby. The primary drive gear 95 also, however, has essentially disposed interior socket 96 which receives an appropriately positioned end of the tilt rod 30 as shown in FIG. 17 and is connected so as to rotate therewith. Therefore, forced rotation of the primary drive gear 95 causes rotation of the tilt rod 30 which in turn serves to rotate each of the tilt stems 28 about their own longitudinal axis due to interengagement of the tilt rod 30 with the first elongated gear element 38 mounted on the carrier frame 18 and its interconnection with the circular gear 44 being a part of and mounted on the tilt stem 28. It should also be mentioned that the plurality of gear components are collectively disposed and dimensioned to define a step-down gear ratio of substantially 5 to 1.

Finally, other features of the present invention include both the control means 31 and the securement means 32 being secured to the housing 10 by means of conventional screw-type connectors 68. In addition, as clearly shown in FIG. 2, the securement means 32 comprises a single roller 69 disposed and configured to receive the cord segments 25', 25''.

What is claimed is:

1. A vertical louver assembly comprising a horizontally disposed housing including a track assembly and elongated tilt rod rotatably mounted within said housing and extending along the length thereof, said assembly comprising:

(a) a control means mounted on said housing and secured to one opposite end of said tilt rod and a securement means mounted on said housing and secured to the other opposite end of said tilt rod, said control means and said securement means disposed and structured for support and interconnection of said tilt rod on said housing, (b) said control means further including an at least partially exposed sprocket gear movably connected to and driven by a pull chain selectively in either of two opposite directions, (c) a drive gear assembly rotatably attached to one opposite end of said tilt rod and connected in driven relation to said sprocket gear, said drive gear assembly including a gear retainer means for engaging and retaining a plurality of secondary gears in a fixed location and in mating driving engagement with a primary drive gear connected to said one opposite end of said tilt rod, (d) an inwardly directed drive gear segment secured to and extending inwardly from said sprocket gear and rotatable therewith, (e) said secondary gears having a stepped gear configuration including a first gear portion in driving engagement with said inwardly directed drive gear and a second reduced gear portion in driving engagement with said primary drive gear, (f) a plurality of carrier assemblies each connected in supported relation to a vertically oriented depending louver extending downwardly from said housing, (g) each carrier assembly comprising a support frame movably mounted along the length of the housing in movable engagement with said track assembly and in selectively spaced relation to one another, (h) each of said support frames including a central aperture dimensioned and disposed to receive and allow positioning of the tilt rod therethrough, said plurality of support frames disposed in surrounding, concentric relation to the tilt rod, (i) a plurality of tilt stems each movably mounted on one of said support frames and each attached in supporting relation to one of the vertical louvers, (j) a first gear element having a substantially elongated, linear configuration and movably mounted on each of said support frames in mating engagement with an outer surface of said tilt rod, whereby rotation of the tilt rod causes linear movement of said first gear element, (k) a second gear element secured to a head portion of each of said tilt stems in mating engagement with a corresponding one of said first gear elements and rotation of said tilt rod, (l) a biasing means mounted on said support frame and positioned in biasing engagement with opposite ends of said first gear element for preventing disengagement from said second gear element, (m) each of said support frames comprising two spaced apart apertures each disposed and dimensioned to allow travel therethrough of a segment of a pull cord assembly, opposite ends of said pull cord segments movably connected to said securement means on opposite ends of said housing, (n) each of said spaced apart apertures positioned in linear alignment with an open ended channel means integrally formed in said support frame, each of said channel means disposed and structured for passage and positioning of the cord segments into and out of respective ones of said spaced apart apertures, and (o) a tilt rod support means mounted within said housing in surrounding, concentric relation to said tilt rod for supplementary support of the tilt rod on said housing along its length and along the least a portion of the length of the housing.

2. An assembly as in claim 1 wherein each of said tilt stems comprises a skirt fixedly mounted adjacent said second gear element and extending transversely outward from the longitudinal axis of said tilt rod, a finger projecting outwardly from said skirt and rotatable therewith; a stop structure including two stop elements fixedly secured to said support frame on opposite sides of said tilt stem and in interruptive stopping engagement with said finger, whereby rotation of said tilt stem is stopped upon engagement between said finger and either one of said stop elements.

3. An assembly as in claim 1 wherein said first gear element comprises a plurality of teeth extending along an outer surface thereof and having a straight line linear configuration disposed in mating engagement with an outer surface of said tilt rod, whereby rotation of said tilt rod causes linear displacement of said first gear element in a common direction.

4. An assembly as in claim 3 wherein said first gear element comprises a plurality of adjacently positioned pockets integrally formed and extending inwardly therein, said plurality of pockets linearly configured to receive and matingly engage a plurality of teeth formed on said second gear element.

5. An assembly as in claim 4 wherein said second gear element comprises a circular pinion gear fixedly secured to one end of said tilt stem and rotatable therewith, whereby rotation of the tilt rod causes rotation of said tilt stem and attached louver through mating engagement between said first and said second gear elements.

6. An assembly as in claim 1 wherein said biasing means comprises two spring elements integrally formed on said support frame and structured to include an inherent flexibility, each spring element disposed in interruptive engagement to one end of said first gear element and in biasing, engagable relation with a correspondingly positioned end of said first gear element.

7. An assembly as in claim 1 wherein said plurality of secondary gears each drivingly engage said primary drive gear and said primary drive gear matingly engaging said one opposite end of said tilt rod for forced rotation thereof.

8. An assembly as in claim 7 wherein said primary drive gear comprises a receiving socket dimensioned and configured to receive said one opposite end of said tilt rod therein and be interconnected thereto for forced rotation thereof.

9. An assembly as in claim 8 wherein said sprocket gear, plurality of secondary gears, primary drive gear and said tilt rod are all collectively rotatable in each of two opposite directions dependent on the direction of travel of said pull chain.

10. An assembly as in claim 1 wherein said tilt rod support means comprises opposite ends thereof mounted on said track means in supporting relation to said tilt rod.

11. An assembly as in claim 10 wherein said opposite ends of said tilt rod support means are movably mounted within correpsonding portions of said track means and connected to said assembly to move along the length of said tilt rod.

12. An assembly as in claim 10 further comprising a sleeve formed on said tilt rod support means and concentrically mounted in surrounding and relation to supporting the tilt rod and extending outwardly from at least one of two opposed surfaces of the tilt rod support means.

13. An assembly as in claim 12 wherein said tilt rod support means comprises an elongated sleeve integrally formed thereon and extending outwardly from both of said two opposed surfaces thereof in surrounding, concentric and supporting relation to said tilt rod.

14. A tilt rod support comprising:

a sleeve having a central zone, said sleeve being sized to receive a tilt rod of a vertical louver assembly therethrough, a pair of opposite ends, including a first end extending radially outwardly of the central zone of said sleeve and a second end extending radially outwardly of the sleeve in opposed relation to said first end, each of said ends being generally rectangular and having an upper edge and an outer edge and a notch at the juncture of the upper edge and outer edge, said opposite ends being sized to engage the track of a vertical louver assembly when the tilt rod is in the sleeve and the tilt rod support spans the track with the track being receivable in the notches of said opposite ends, and said tilt rod support having an opening through each opposite end to receive an operating cord of the vertical louver assembly, said tilt rod support disposed to provide supplementary support of the tilt rod along its length.

* * * * *